US005340017A

United States Patent [19]

Tighe

[11] Patent Number: 5,340,017

[45] Date of Patent: * Aug. 23, 1994

[54] RETURN MAILING UNIT

[76] Inventor: John F. Tighe, P.O. Box 1086, Truro, Mass. 02666

[ * ] Notice: The portion of the term of this patent subsequent to Dec. 8, 2009 has been disclaimed.

[21] Appl. No.: 986,853

[22] Filed: Dec. 4, 1992

Related U.S. Application Data

[63] Continuation-in-part of Ser. No. 692,668, Apr. 29, 1991, Pat. No. 5,169,060.

[51] Int. Cl.[5] ..... B65D 27/06

[52] U.S. Cl. ..... 229/300; 229/301; 229/305; 229/92.1; 229/70

[58] Field of Search ..... 229/300, 302, 305, 301, 229/70, 92.1, 92.7

[56] References Cited

U.S. PATENT DOCUMENTS

| | | | |
|---|---|---|---|
| 2,872,100 | 2/1959 | Coffin | 229/92.1 |
| 3,460,744 | 8/1969 | Turkenkopf | 229/92.1 |
| 3,858,792 | 1/1975 | Volkert | 229/301 |
| 3,941,309 | 3/1976 | Gendron | 229/301 |
| 4,044,942 | 8/1977 | Sherwood | 229/305 |
| 4,093,117 | 6/1978 | Morse | 229/92.1 X |
| 4,520,958 | 6/1985 | Jones . | |
| 4,801,076 | 1/1989 | Schoenleber et al. | 229/92.7 |
| 5,169,060 | 12/1992 | Tighe et al. . | |

FOREIGN PATENT DOCUMENTS

| | | | |
|---|---|---|---|
| 30176 | 7/1909 | Sweden | 229/70 |

*Primary Examiner*—Allan N. Shoap
*Assistant Examiner*—Jes F. Pascua
*Attorney, Agent, or Firm*—Connolly & Hutz

[57] ABSTRACT

A return mailing unit is in the form of a free-standing newspaper advertising insert which includes two end panels and two intermediate panels between the end panels. The intermediate panels are at least partially connected to the end panels by a weakened fold line while the intermediate panels are connected to each other by a non-weakened fold line. One of the end panels is in the form of at least one envelope. The other end panel is divided into two sections with at least one of the sections being completely detachable at its weakened fold line and by a weakened line which divides that end panel in two so that the detachable section could be inserted into an envelope from the other end panel to serve as a return mailing unit. In a variation of the return mailing unit a magazine cover has reply card extensions at both the front and back covers. The reply card extensions are detachable from the covers so as to serve as a return mailing unit. In a third version the direct mail piece is in the form of a gate fold having a plurality of intermediate panels and two end panels. One of the end panels is an envelope and the other end panel is divided into a plurality of sections by a weakened fold line between each section so that a section can be detached and inserted in the envelope as a return mailing unit.

15 Claims, 7 Drawing Sheets

RETURN MAILING UNIT

CROSS-REFERENCE TO RELATED APPLICATION

This application is a continuation-in--part of application Ser. No. 692,668 filed Apr. 29, 1991, U.S. Pat. No. 5,169,060.

In direct mail advertising solicitation and the like, it is customary to mail to the original addressee information regarding certain products or services of the sender. In such direct mailing it is also desirable if some means could be provided so that the original addressee could readily respond by return mail. The most common means used for this purpose is to include an outer envelope containing information regarding, for example, products or services and then to also include a reply postcard or a reply envelope within the outer envelope so that the original addressee could conveniently respond by return mail.

It would be desirable if this form of direct mailing could be practiced in a way so as to minimize costs and efforts by the original addressee in returning a response. It would also be desirable to provide a practice which facilitates as much as possible the original addressee making such response.

Parent application Ser. No. 692,668 describes various forms of the direct and return mailing units which are intended to meet the above needs. It would be desirable if variations of those units could be developed to increase the selectivity of direct mail advertising solicitation approaches.

SUMMARY OF INVENTION

An object of this invention is to provide a return mailing unit which expands upon the types of units described in the parent application.

A further object of this invention is to provide such a return mailing unit which includes end panels that can be used to respond to a direct solicitation.

In accordance with one variation of this invention the return mailing unit is a free-standing newspaper advertising insert which has intermediate panels and end panels. One of the end panels is in the form of at least one envelope and is connected to its adjacent intermediate panel by a weakened fold line. The other end panel is also connected to its intermediate panel by a fold line which is weakened over at least a portion of its length and that end panel includes a transverse weakened fold line which divides the end panel into sections so that one of the sections could be detached at its section dividing fold line and at its fold line adjacent to the intermediate panel. The detached section could then be inserted in an envelope from the other end panel to function as a return mail for return mailing purposes. Alternatively one or both of the end panels is left unfolded and simply extends outwardly from its adjacent panel.

In another embodiment of this invention the return mailing unit is part of a magazine. More specifically, the front and back covers of the magazine contains folded end panels. One of the end panels is in the form of a detachable envelope while the other end panel includes at least one section which could be detached and inserted into the envelope for return mailing purposes. Alternatively, both of the end panels may include detachable sections which are in the form of return postcards.

In a further variation of this invention the return mailing unit is a gate fold having two end panels wherein one of the end panels is in the form of an envelope and the other end panel may be separated into sections so that one of the sections could be inserted into the envelope for return mailing purposes.

THE DRAWINGS

DETAILED DESCRIPTION

The parent application Ser. No. 692,668 filed Apr. 29, 1991 discloses various forms of direct and return mailing units. In general, the various practices of the invention described in the parent application include the provision of end panels which can be detached from the unit for use in return mail. The end panels in some embodiments are in the form of envelopes and in other embodiments are in the form of reply cards. The details of parent application Ser. No. 692,668 are incorporated herein by reference thereto.

The present invention as illustrated in FIGS. 1–12 is based upon the concepts of the parent application and include variations of those concepts.

Figure 1:
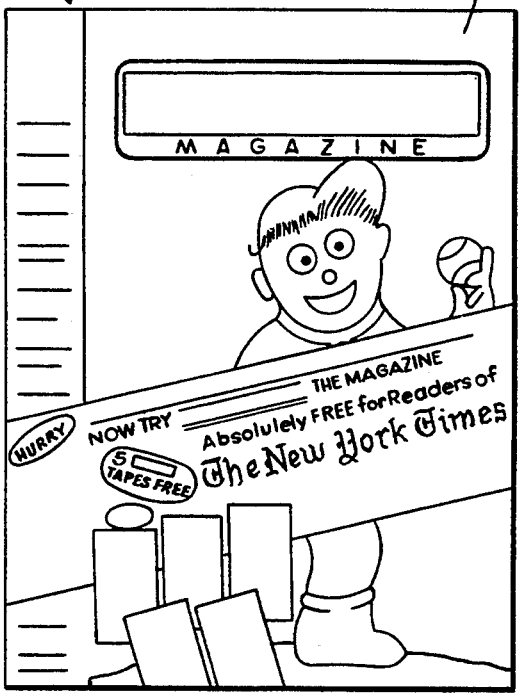
FIG. 1 is a top plan view of a return mailing unit in accordance with one embodiment of this invention in its folded condition.
Figure 2:
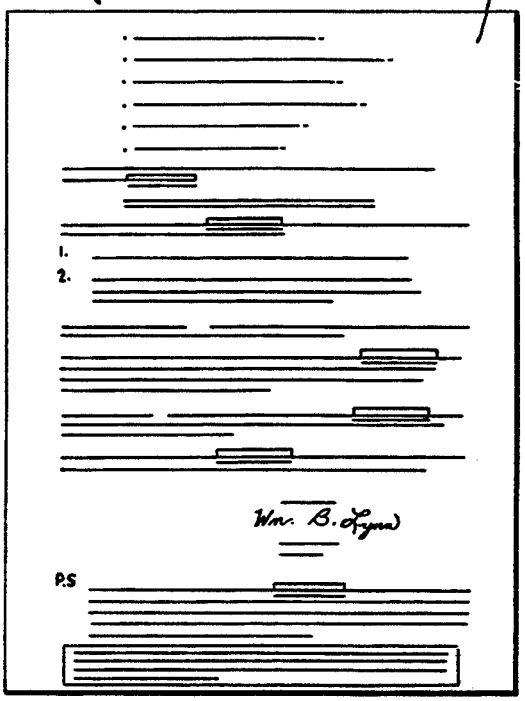
FIG. 2 is a bottom plan view of the mailing unit shown in FIG. 1 in its folded condition.
Figure 3:
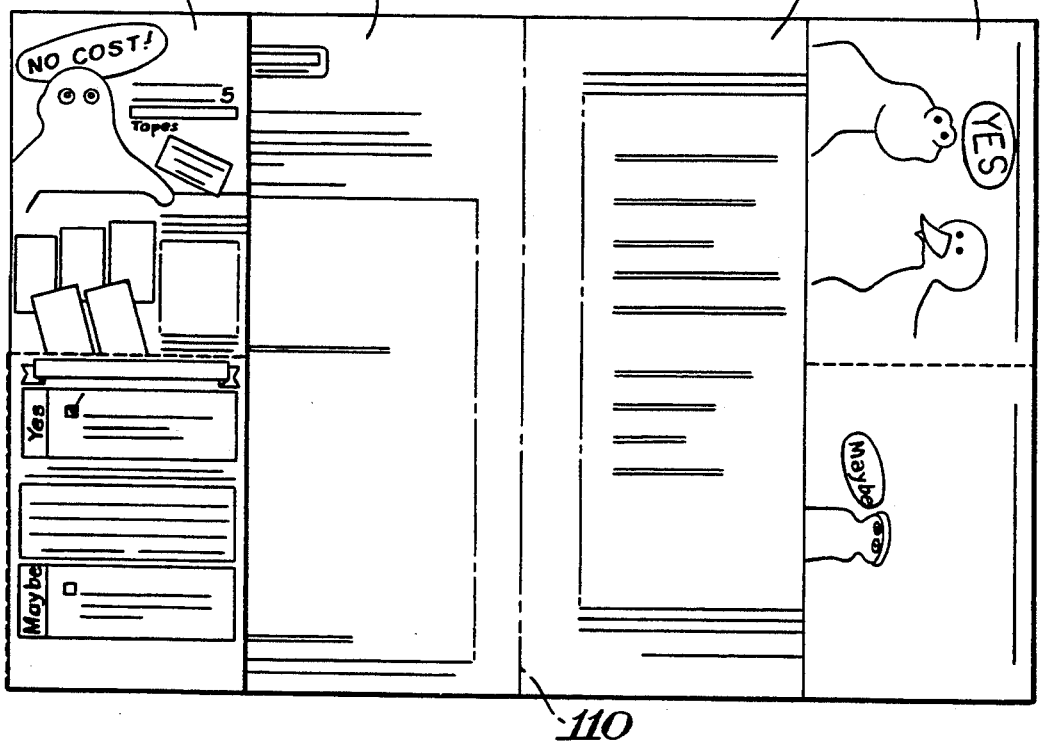
FIG. 3 is a top plan view of the mailing unit shown in FIGS. 1–2 in a partially unfolded condition.
Figure 4:
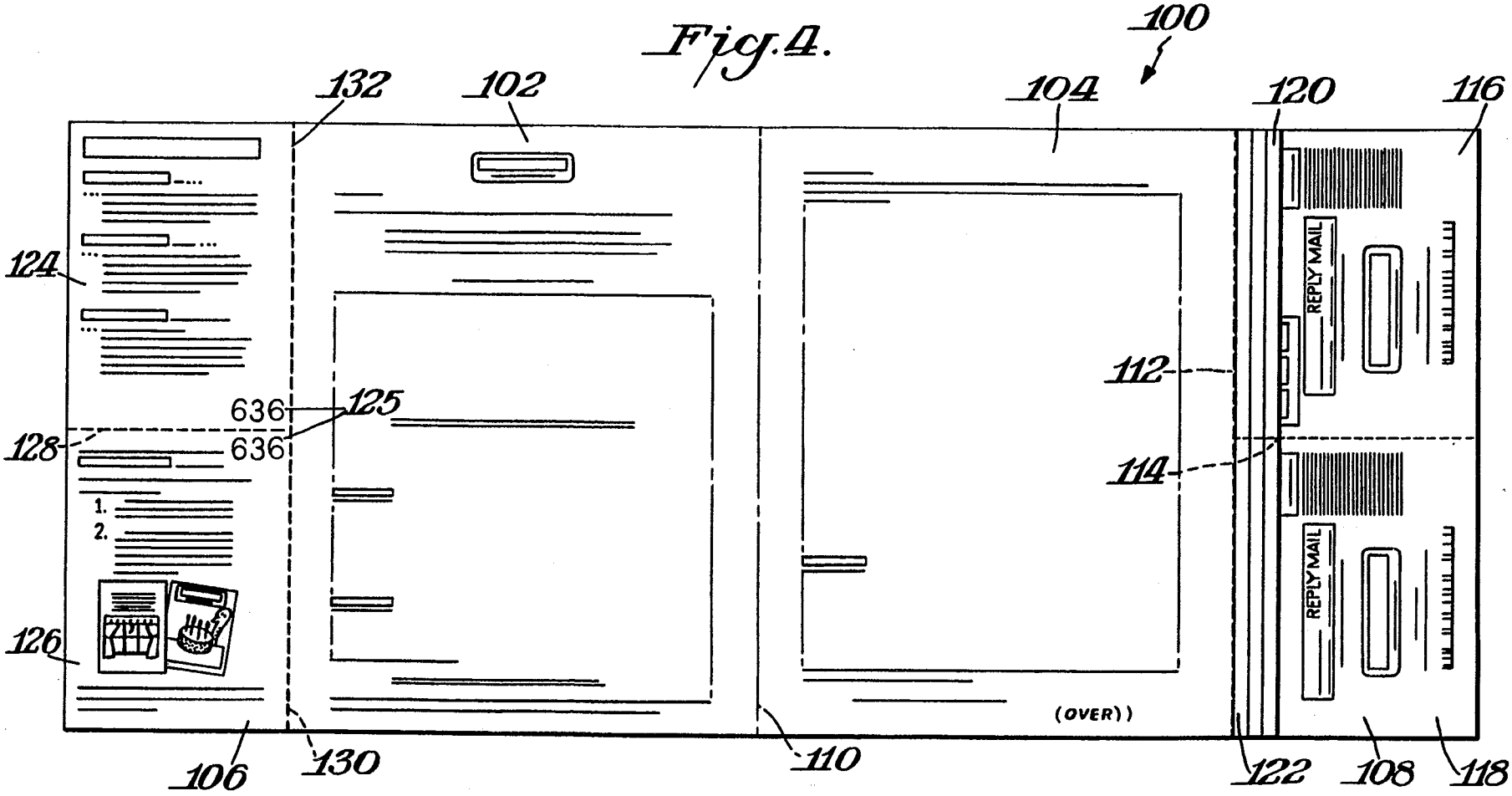
FIG. 4 is a view similar to FIG. 3 in the completely unfolded condition.
Figure 5:
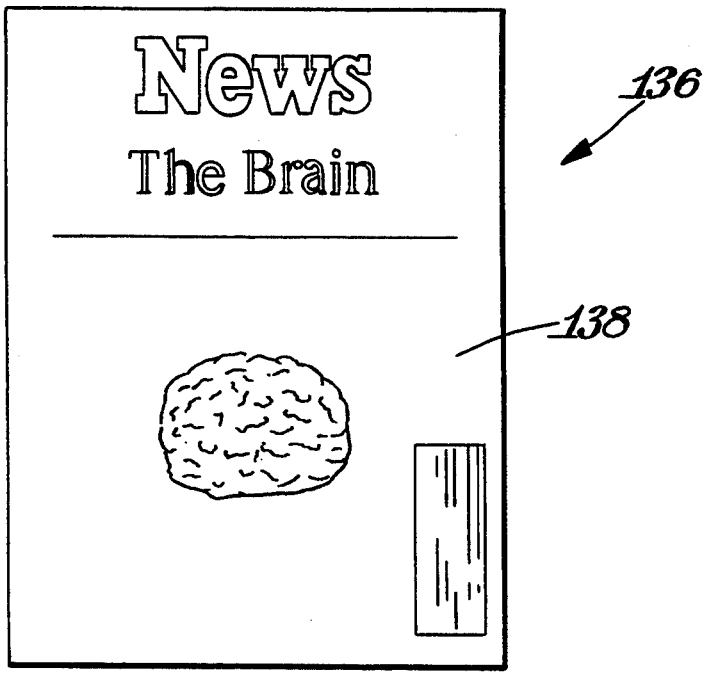
FIG. 5 is a top plan view of a further embodiment of this invention showing a return mailing unit as part of a magazine.

FIGS. 1–4 are directed to one practice of this invention wherein the return mailing unit 100 is in the form of a free-standing newspaper advertising insert such as might be used in Sunday's supplements. As shown in FIG. 4 return mailing unit 100 includes a plurality of intermediate panels. Two such intermediate panels 102,104 are used. A larger or smaller number of intermediate panels may also be used in accordance with this invention. Unit 100 also includes a pair of end panels 106, 108. Where there are a plurality of intermediate panels the intermediate panels are connected to each other by a non-weakened fold line 110. Fold line 110 in the preferred practice of this invention is also the center line for unit 100 when an even number of intermediate panels are used.

In accordance with this invention the end panels 106,108 are used for direct mailing purposes. As illustrated end panel 108 is connected to its adjacent intermediate panel 104 by a weakened fold line 112 so that the end panel can be detached from adjacent intermediate panel 104. End panel 108 is also divided into a plurality of sections by a weakened fold line between each section. In the illustrated form a single dividing weakened fold line 114 is used to divide end panel into two sections 115 and 118. Each section is in the form of an envelope by being of multi-layered thickness with three edges of the layers joined together to form the envelope and with a flap 120,122 being an integral extension of the outermost layer. In the illustrated form flaps 120,122 are located at the weakened fold line 112. The invention, however, may also be practiced where the flaps are integral with the lower layer and are connected to intermediate panel 104 by the weakened fold line itself.

End panel 106 is also divided into a number of sections 124,126 by dividing line 128. Dividing line 128 is a weakened fold line to permit the individual sections to be detached from each other. A fold line also connects end panel 106 with its adjacent intermediate panel 102. The entire fold line may be weakened so that both sections 124 and 126 can be detached or as illustrated a portion 130 of the fold line is weakened while the other portion 132 is a non-weakened fold line so that only section 126 would be detached. Where end panel 108 includes one or more envelopes the detached section 126 could be inserted into the envelope as part of the return mail. It is to be understood, however, that any or all of the sections 116,118 124,126 may be in the form of return postcards rather than envelopes and inserts for the envelopes.

In practice end panel 104 would be folded at fold line 112 into contact with intermediate panel 104 and end panel 106 would be folded at its fold line 130,132 into contact with its intermediate panel 102 as shown in FIG. 3. The partially folded unit would then be folded at the fold line 110 which connects intermediate panels 102,104 to form the free-standing newspaper advertising insert illustrated in FIGS. 1 and 2. Where an odd number of intermediate panels are used there would be a sequential folding of the intermediate panels to reach the final folded condition of panels 1 and 2.

As illustrated in FIGS. 3 and 4 each of the end panels 106,108 is of lesser length of each of the intermediate panels 102,104.

Unit 100 may also be used where it is desired to provide some identification of a specific insert as compared to other inserts such as in the awarding of prizes. This is frequently done with sweepstakes awards. As shown in FIG. 4 the detachable section 126 could include an identifying number 125. The same number 125 would be imprinted on permanent stub 124. Thus, where insert 126 is returned as part of a contest entry the user would have the remaining stub 124 as proof of the same number 125. If desired, the fold line for permanent stub 124 could be weakened so that the stub 124 could be detached, thus obviating the need for the user to save the entire insert. Numbers 125 could be sequentially applied to individual inserts in a manner known in the art. It is to be understood that the identifying number 125 could be alphanumeric or other symbols which would make each specific insert different from otherwise identical inserts.

Unit 110 could also be varied by having one or both of the end panels 106,108 left in the unfolded condition shown in FIG. 4. This is a useful variation in situations where an advertiser is charged by a newspaper company for the number of pages of the insert. Where there is a fold, the folded panel might be considered as a separate page. If the panel, however, is left unfolded it is not a separate page. Thus, in one variation unit 100 might simply be folded at center fold line 110 with the end panels 106 and 108 left unfolded. Alternatively, one of the end panels, such as end panel 106 could be folded against its adjacent end panel 102 and the unit then folded at fold line 110 with end panel 108 remaining extending outwardly in what is known as a short fold. The unit would still be considered for purposes of this invention as having four end panels, although the weakened lines such as weakened lines 112 and 130 would function only as connection lines which could be perforation or detachable lines and not fold lines.

Unit 100 is particularly useful where the detachable panel 106 functions as an order form which would be inserted into an envelope 116 or 118 of the opposite end panel. It is to be understood that the specifically illustrated locations of the inserts and envelopes is not critical to the practice of this invention. Thus, for example, the envelopes might be located where end panel 106 is located and the insert and stub could be located where panel 108 is located.

In the preferred practice of unit 100 the unit is a free-standing newspaper insert and thus there would be no original addressee information or postage. It is to be understood however, that the invention may also be practiced where unit 100 is itself a direct mailing unit (as in the parent application) which would have the original addressee information and postage on one of the exposed surfaces of intermediate panels 102 or 104.

FIGS. 5–8 illustrate a further return mailing unit 136 which is in the form of a magazine having a top cover 138 and a bottom cover 140. An end panel 142 is integrally connected to top cover 138 while an end panel 144 is integrally connected to bottom cover 140. Since magazine covers are conventionally thicker than the magazine pages, the end panels would be of proper mailing thickness by being integral with the magazine covers.

Figure 6:
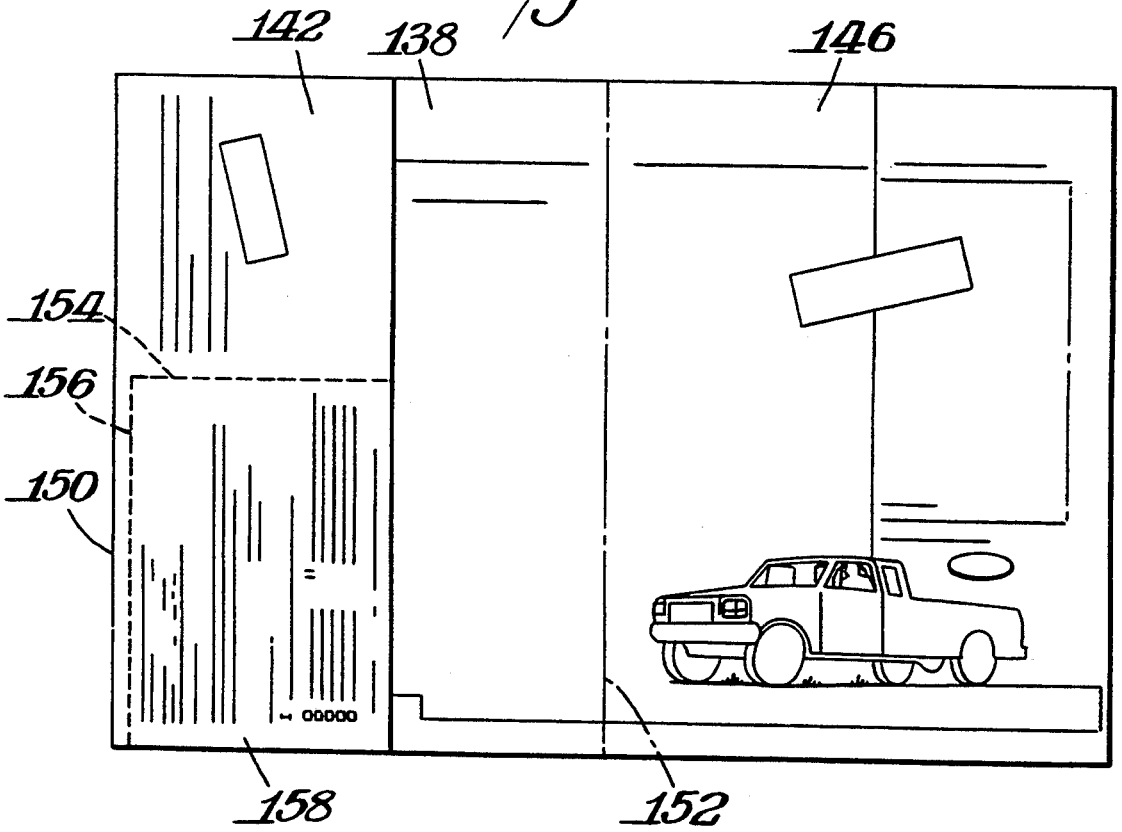
FIG. 6 is a top plan view of the mailing unit shown in FIG. 5 with the front cover folded open and the end panel folded on the inner surface of the front cover.
Figure 7:
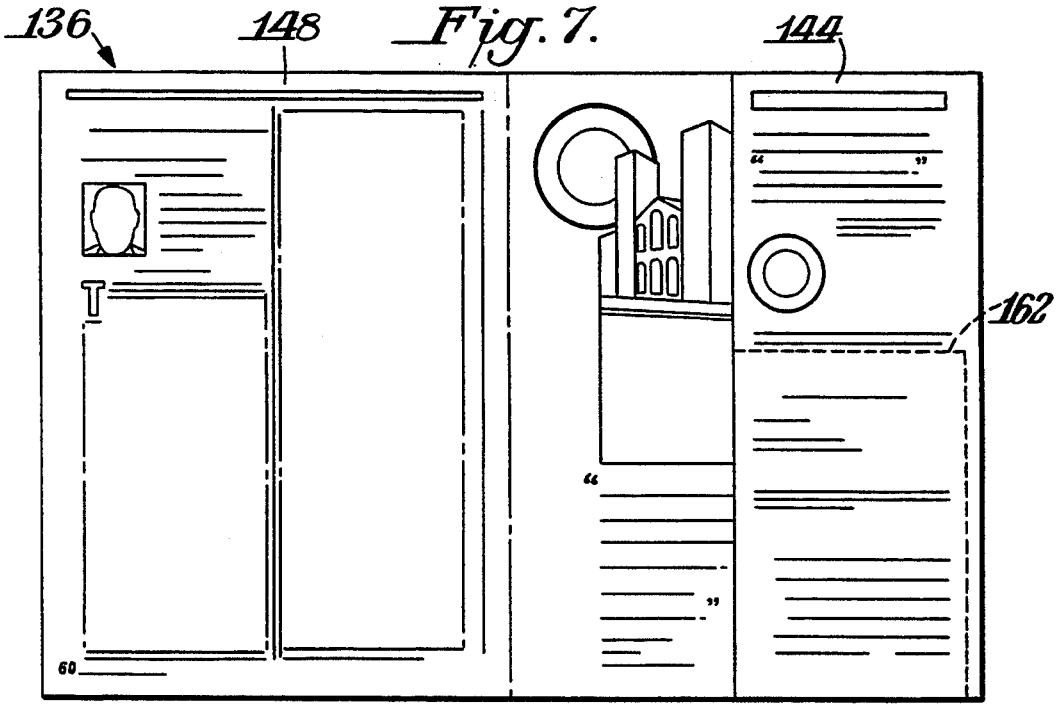
FIG. 7 is a top plan view of the magazine shown in FIG. 5 with the bottom cover folded open and the end panel folded on the inner surface of the bottom cover.
Figure 8:
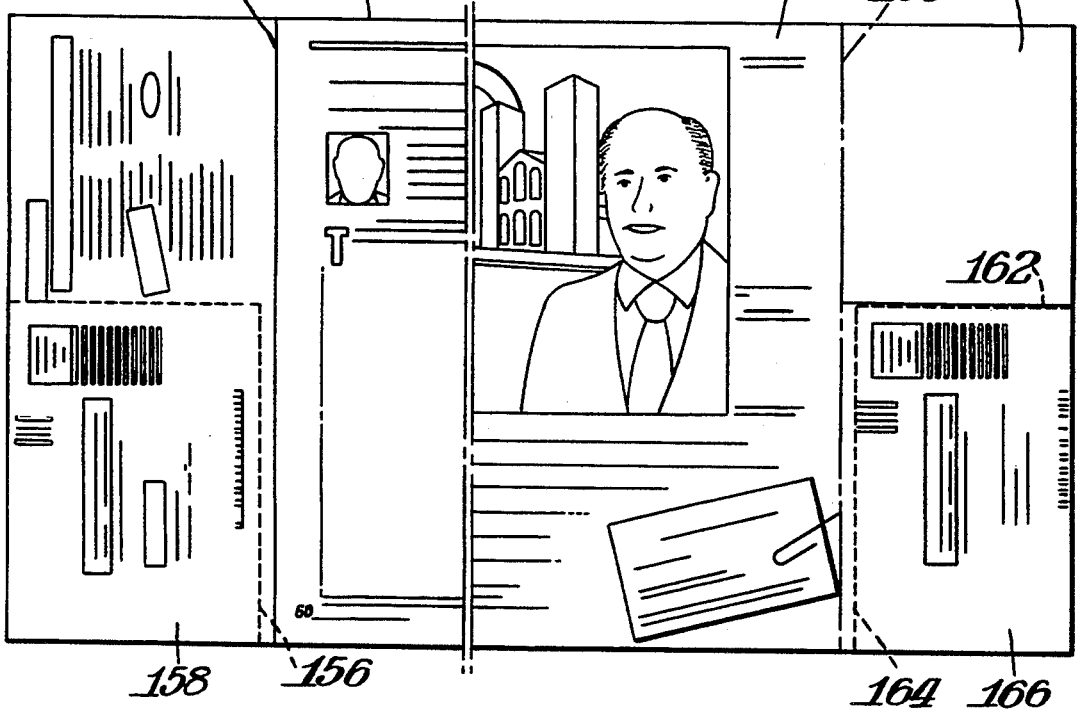
FIG. 8 is a top plan view of the mailing unit shown in FIGS. 5–7 with the bottom cover open and both end panels folded to an open condition.

FIG. 6 illustrates the unit 136 with the front cover 138 of the magazine folded open so that the first page 146 of the magazine is exposed. As shown therein end panel 142 is folded into contact with the inner surface of front cover 138. FIGS. 7–8 show the magazine open at the rear cover so that the last page 148 is exposed. FIG. 8 shows how the end panel 142 connected to the front cover 138 extends beyond the edge of the last page 148 when the end panel 142 is unfolded to its completely open condition.

As shown in FIG. 6 end panel 142 is connected to front cover 138 by a fold line 150 which is the edge of front cover 138 remote from the binding 152 at the center of the magazine. FIG. 8 also illustrates the fold line 150 which would be co-linear with the outer edge of the last page 148 of the magazine. End panel 142 is divided into a plurality of sections. This may be done in the same manner as in unit 100 wherein a weakened fold line extends completely across the end panel. Alternatively, as illustrated in FIGS. 6 and 8 the sectioning of end panel 142 is achieved by two weakened lines 154,156 (at the fold line or indented) so that a section 158 may be detached from the remainder of end panel 142. Section 158 may be of extra thickness with respect to the sheets of a magazine and if desired also with respect to the thickness of the end covers. The extra thickness is desired so that section 158 could function as a return postcard. The bottom cover end panel 144 is similarly connected to its cover 140 by a fold line 160 and may include a pair of weakened lines 162,164 to form a detachable section 166 which may be used as a postcard in the same manner as postcard 158. It is to be understood that end panel 144 may also be divided into sections in the same manner as the end panels of unit 100. Additionally, where a free-standing magazine insert is used it is preferred that the return mailing item be a postcard. The invention, however, may be broadly practiced where at least one of the end panels includes one or more envelopes as in unit 100.

Unit 130 would preferably be used by having each end panel be part of an advertisement on the inner surface of its cover and on the adjacent first or last page of the magazine.

One of the end panels, such as end panel 142 could have the identical numbers, such as sweepstakes numbers, or other indicia on the returned section (e.g. postcard 158) and on a stub section as previously described.

Unit 136 represents a distinct departure from conventional techniques in that the use of a magazine or catalogue cover provides a whole new area of advertising sales. As previously indicated each end panel could be of the same type of advertising message as the inner surface of its cover and of the adjacent page in the magazine or catalogue. Alteratively, the end panels could be used for non-related messages including subscriptions to the magazine or catalogue or to other advertisers.

FIGS. 9–12 illustrate a further return mailing unit 170 which is in the form of a gate fold.

Figure 12:
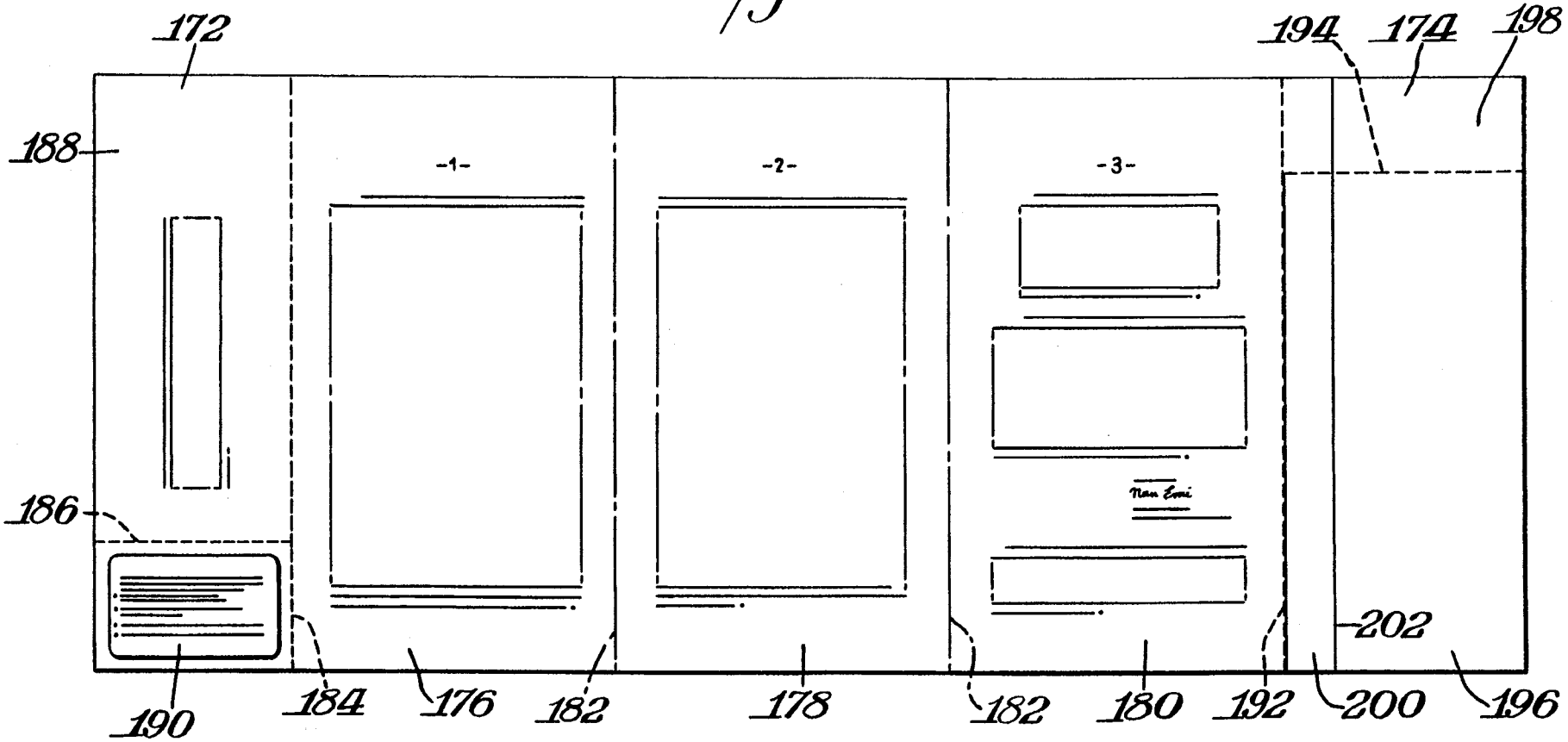
FIG. 12 is a view similar to FIG. 11 showing the end panels in their unfolded condition.

FIG. 12 illustrates unit 170 in its completely unfolded condition. As shown therein a pair of end panels 172,174 is provided with a plurality of intermediate panels. In the illustrated embodiment there are three intermediate panels 176,178 and 180. It is to be understood, however, that any even or odd number of intermediate panels may be used. The intermediate panels are connected to each other by non-weakened fold lines 182. The end panels 172,174 can take any suitable form for use in return mailing and could include sweepstake numbers, as previously described. The end panels may be of the type of construction illustrated and described for unit 100 where one of the end panels is divided into sections with each section forming an envelope while the other end panel is completely divided into sections wherein at least one of the sections is detachable for use as an insert in an envelope or as a reply postcard. Alternatively, the end panels may take the form of the end panels illustrated for unit 136 where only a portion of each end panel is detached and that detached portion is in the form of a reply postcard. The illustrated form of end panels 172,174 show other alternatives which of course may be used for units 100,136. As illustrated end panel 172 has a weakened fold line 184 which connects end panel 172 with its intermediate panel 176. A sectioning fold line 186 divides end panel 172 into two detachable sections 188,190. Each of the sections may be in the form of envelopes or inserts as illustrated. Section 188 is an insert which would be used with an envelope from end panel 174. As also illustrated section 190 is a membership card.

End panel 174 is connected to intermediate panel 180 by a weakened fold line 192. A second weakened fold line or perforated line 194 divides panel 174 into two sections 196 and 198. Section 196 is illustrated as being of multi-layer extra thickness with the layers spaced from each other and joined along three sides to form an envelope. The flap of the envelope 200 extends from the lower layer and is integral with intermediate panel 180. Section 198 could be blank or could be used for advertising information. Since section 198 does not function as part of the return mailing unit the fold line which connects section 198 with intermediate section 180 could be a non-weakened portion similar to fold line 132 of unit 100. The upper layer of the envelope terminates at edge 202 which would be the fold line for flap 200 when envelope 196 is detached.

Figure 9:
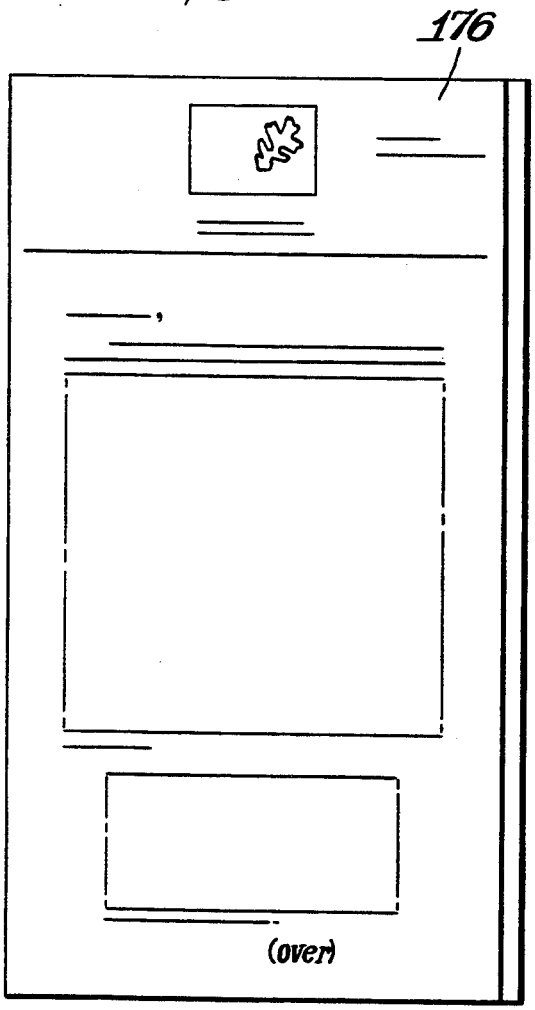
FIG. 9 is a bottom plan view of a further form of mailing unit in accordance with this invention.
Figure 10:
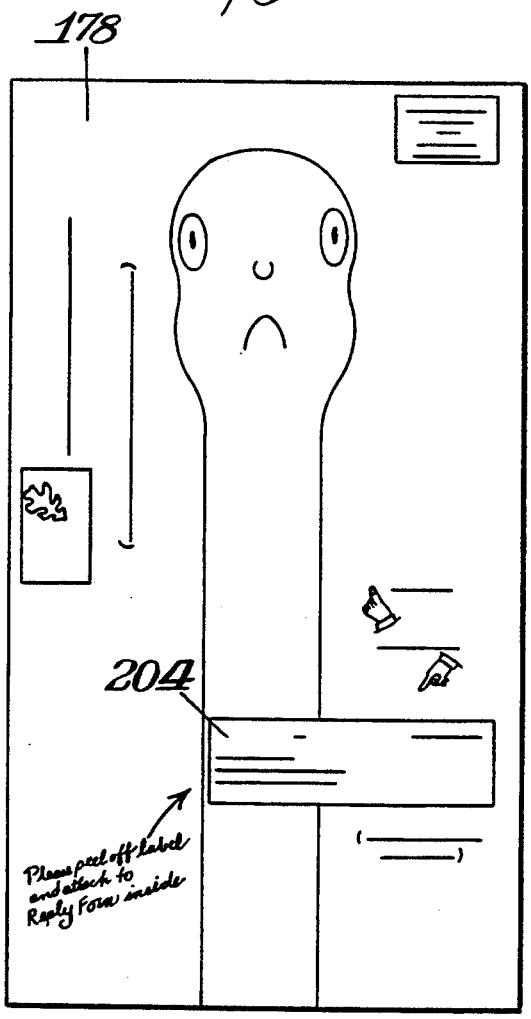
FIG. 10 is a top plan view of the mailing unit shown in FIG. 9.
Figure 11:
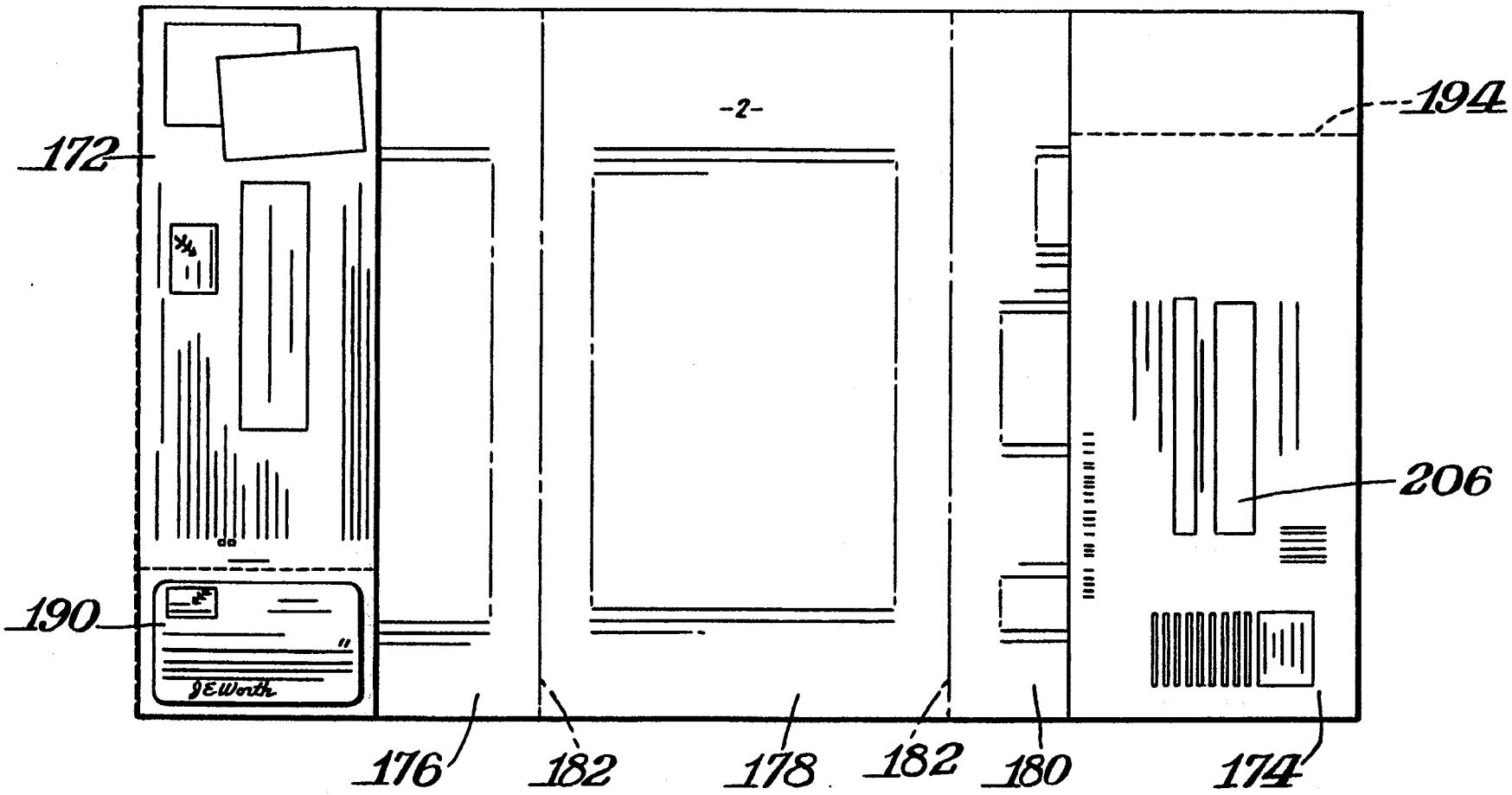
FIG. 11 is a top plan view of the mailing unit shown in FIGS. 9–10 with the intermediate panel in an unfolded condition and the end panels folded upon their respective intermediate panels.

FIG. 11 shows unit 170 where the end panels 172 and 174 are each folded into contact with its adjacent intermediate panel. One of the intermediate panels, such as intermediate panel 176 could be made of slightly smaller length than the remaining intermediate panels so that the unit could then be folded at the fold line connecting panels 176 and 178 and then folded again at the fold line connecting panels 180 and 178 so that the shorter intermediate panel 176 would not interfere with this later folding. FIGS. 9–10 illustrate unit 170 in its folded condition. As shown therein the original address information 204 would be visible by being located on the exposed side of the center intermediate panel 178.

If desired the entire end panel 174 could be in the form of a reply envelope rather than having a remaining stub 198.

The return address information 206 on envelope 196 is shown in FIG. 11 where panel 174 is folded against its adjacent intermediate panel 180.

What is claimed is:

1. A return mailing unit comprising a unitary sheet having two opposite longitudinal edges interconnected by two transverse edges, said sheet two end panels and at least two intermediate panels between said panels being connected to each other by a fold line parallel to said transverse edges, said intermediate panels being of generally the same size as each other, an end panel connecting line parallel to said transverse edges connecting each of said end panels to its adjacent intermediate panel, at least a portion of each of said end panel connecting lines being perforated to form a perforated connecting line, each of said end panels being of lesser length along said longitudinal edges than the length of each of said intermediate panels, at least one of said end panels being of multi-layer extra thickness when said sheet is in its unfolded condition with the layers spaced from each other to form at least one envelope having joined edges and a sealing flap, said envelope being readily detachable from its adjacent intermediate panel by tearing said sheet at said perforated connecting line of said envelope, said intermediate panels being at least as wide from one longitudinal edge to the other longitudinal edge as said envelope when said envelope is detached and is in a condition for return mailing, and the other of said end panels being readily detachable from its adjacent intermediate panel at said perforated portion of said connecting line for said other of said end panels whereby at least a portion of said other of said end panels may be detached and be an insert into said envelope to include reply information when said envelope is used for return mailing.

2. The unit of claim 1 wherein said other of said end panels is divided into two sections by a perforated line which extends to its perforated connecting line in a perpendicular direction whereby at least one of said sections may be detached from said unit independently of the other of said sections to comprise said insert.

3. The unit of claim 2 wherein said connecting line for said other end panel is perforated at one of said two sections and is a non-perforated fold line at the other of said two sections whereby only one of said two sections is readily detachable.

4. The unit of claim 2 wherein each of said end panel connecting lines is a fold line, each of said end panels being folded against its adjacent intermediate panel, and said end panels contacting each other when said intermediate panels are folded at said fold line connecting said intermediate panels.

5. The unit of claim 2 wherein said one section contains an identifying number distinct for said insert, and an identical identifying number being on another portion of said unit.

6. The unit of claim 2 wherein said unit comprises a free standing insert for newspapers.

7. The unit of claim 6 wherein said connecting line for said other end panel is perforated at one of said two sections and is a non-perforated fold line at the other of said two sections whereby only one of said two sections is readily detachable.

8. The unit of claim 2 wherein said extra thickness end panel has its connecting line perforated from longitudinal edge to the other with a perforated panel dividing line extending perpendicular to and intersecting said panel connecting line to divide said extra thickness end panel into two sections, and each of said sections being in the form of multi-layer extra thickness joined at three edges to form an envelope and having a flap.

9. The unit of claim 8 wherein there are two intermediate panels.

10. A direct and return mailing unit comprising a unitary sheet having two opposite longitudinal edges interconnected by two transverse edges, said sheet having at least three panels in the form of two end panels and at least one intermediate panel, a fold line parallel to said transverse edges connecting each of said panels to its adjacent panel, at least a section of one of said end panels being of multi-layer extra thickness when said sheet is in its unfolded condition, said multi-layers being joined at three edges to form an envelope, said sheet and said panels having a front side and a back side, one of said intermediate panels being an original addressee panel having original addressee information and postage on said front side, said extra thickness end panel having return addressee information and postage on one of said sides, said fold line for said extra thickness panel being a perforated line to facilitate detachment of said extra thickness section, said envelope being readily detachable from its adjacent intermediate panel by tearing said sheet at said perforated connecting line of said envelope, said intermediate panels being at least as wide from one longitudinal edge to the other longitudinal edge as said envelope when said envelope is detached and is in a condition for return mailing, said panels being folded against each other to provide a folded assembly of the size of said original addressee panel with said original addressee information visible and said return addressee information concealed, said folded assembly having exposed outer sides, said extra thickness panel being of lesser length along said longitudinal edges than the length of each of said remaining panels, at least a portion of said fold line for the other of said end panels being a perforated line to facilitate detachment of at least a section of said other end panel, said section being of a size to fit into said envelope as an insert, and said end panels being folded inwardly to be concealed when said unit is in its folded condition.

11. The unit of claim 10 wherein the entire fold line for other said end panel is a perforation line, and a second perforation line intersecting said perforation line for said other end panel and being perpendicular thereto to divide other said end panel into two sections.

12. The unit of claim 11 wherein said at least one intermediate panel comprises three intermediate panels, one of said intermediate panels being of lesser length along said longitudinal edges than the other two of said intermediate panels, and said one intermediate panel being folded between said other two intermediate panels when said unit is in its folded condition.

13. A return mailing unit comprising a unitary sheet having two opposite longitudinal edges interconnected by two transverse edges, said sheet having at least three panels in the form of two end panels and at least one intermediate panel, a fold line parallel to said transverse edges connecting each of said panels to its adjacent panel, at least a section of one of said end panels being of multi-layer extra thickness when said sheet is in its unfolded condition, said multi-layers being joined at three edges to form an envelope, said sheet and said panels having a front side and a back side, one of said intermediate panels being an original addressee panel having original addressee attention information on said front slide, said extra thickness end panel having return addressee information and a postage area on one of said sides, said fold line for said extra thickness panel being a perforated line to facilitate detachment of said extra thickness section, said envelope being readily detachable from its adjacent intermediate panel by tearing said sheet at said perforated connecting line of said envelope, said intermediate panels being at least as wide from one longitudinal edge to the other longitudinal edge as said envelope when said envelope is detached and is in a condition for return mailing, said panels being folded against each other to provide a folded assembly of the size of said original addressee panel with said original addressee attention information visible, said folded assembly having exposed outer sides, said extra thickness panel being of lesser length along said longitudinal edges than the length of said original addressee panel, at least a portion of said fold line for the other of said end panels being a perforated line to facilitate detachment of at least a section of said other end panel, said section being of a size to fit into said envelope as an insert, and side end panels being folded inwardly to fully expose said front side of said original addressee panel when said unit is in its folded condition.

14. The unit of claim 13 wherein each of said end panels includes at least one detachable portion for use as a reply form.

15. The unit of claim 14 wherein there are two of said reply forms, one of said reply forms being usable as an affirmative reply, and the other of said reply forms being usable as a negative reply.

* * * * *